US007903829B2

(12) United States Patent
Kubota

(10) Patent No.: US 7,903,829 B2
(45) Date of Patent: Mar. 8, 2011

(54) MICROPHONE

(75) Inventor: Hirohisa Kubota, Saitama (JP)

(73) Assignee: Sony Corporation, Tokyo (JP)

( * ) Notice: Subject to any disclaimer, the term of this patent is extended or adjusted under 35 U.S.C. 154(b) by 1060 days.

(21) Appl. No.: 11/408,011

(22) Filed: Apr. 21, 2006

(65) Prior Publication Data

US 2006/0239475 A1 Oct. 26, 2006

(30) Foreign Application Priority Data

Apr. 22, 2005 (JP) ..... P2005-124767

(51) Int. Cl.
*H04R 25/00* (2006.01)
*H04R 3/00* (2006.01)
*H04R 9/08* (2006.01)

(52) U.S. Cl. ..... 381/174; 381/113; 381/355; 381/170; 381/356

(58) Field of Classification Search ..... 381/92, 381/111, 113, 174, 256
See application file for complete search history.

(56) References Cited

U.S. PATENT DOCUMENTS

| | | | | |
|---|---|---|---|---|
| 4,329,547 | A * | 5/1982 | Imai | 381/163 |
| 2004/0105557 | A1* | 6/2004 | Matsuo | 381/92 |

FOREIGN PATENT DOCUMENTS

| | | |
|---|---|---|
| JP | 55-120300 | 9/1980 |
| JP | 57-010597 A | 1/1982 |
| JP | 58-073692 | 5/1983 |
| JP | 60-022897 | 2/1985 |
| JP | 04-109798 | 4/1992 |
| JP | 04-158000 | 5/1992 |
| JP | 2000-197180 | 7/2000 |

OTHER PUBLICATIONS

Japanese Office Action dated Dec. 18, 2007 for Japanese Application No. 2005-124767.
Japanese Office Action issued Jul. 14, 2009 for corresponding Japanese Application No. 2005-124767.

* cited by examiner

*Primary Examiner* — Brian Ensey
*Assistant Examiner* — Sunita Joseph
(74) *Attorney, Agent, or Firm* — Rader, Fishman & Grauer PLLC

(57) ABSTRACT

A microphone having: a first bidirectional microphone unit formed by connecting two unidirectional microphone units, each of which has a vibrating section on a front side thereof, back to back; and a second bidirectional microphone unit formed by connecting two unidirectional microphone units, each of which has a vibrating section on a front side thereof, back to back, and a directional axis of the second bidirectional microphone unit is arranged to be shifted by 90 degrees with respect to a directional axis of the first bidirectional microphone unit.

5 Claims, 6 Drawing Sheets

MICROPHONE

BACKGROUND OF THE INVENTION

1. Field of the Invention

The present invention relates to a capacitor microphone capable of providing favorable directivity and frequency characteristic.

2. Description of the Related Art

An output voltage of a capacitor microphone unit is proportional to a displacement of a vibrating membrane. If the capacitor microphone unit is configured as a non-directional microphone unit, the capacitor microphone unit has no frequency dependence at a frequency lower than a resonance point of a vibrating system. However, once directivity is provided for the capacitor microphone unit, an electromotive force applied to the vibrating membrane has frequency dependence.

FIG. 8 shows the most standard configuration of a unidirectional microphone unit. FIG. 8 shows an internal structure of the directional microphone unit. In a cylindrical outer casing 11, a case 12 having a rear plate 12R on one end of a cylindrical body in an axial direction is housed. On the other end of the case 12 in the axial direction, a diaphragm (for example, a thin vibrating membrane; a vibrating section) 13 for closing the open end of the case 12 is provided.

At the location separated from the diaphragm 13 by a predetermined distance toward the rear plate 12R, a back plate 14 including a plurality of holes perforated therethrough is provided. In the approximate center of the back plate 14 in a radial direction, an electrode bar 14*a* having a predetermined diameter is formed. The electrode bar 14*a* is provided to extend toward the rear plate 12R so that its end penetrates through the rear plate 12R to form an electrically-conductive terminal 14*aa*.

A plurality of through holes 15 are provided in the rear plate 12R. An acoustic resistor 16 made of, for example, cloth is provided on an end of each of the through holes 15, the end being on the outer side of the rear plate 12R. A thin fluid layer 17 is formed by a gap between the diaphragm 13 and the back plate 14. An air resistance of the thin fluid layer 17 is set high enough to prevent a resonance of the diaphragm 13 at a high frequency and not to greatly affect the directivity and the frequency characteristic.

An area on the back side of the back plate 14, which is surrounded by an inner circumference of the case 12, is a hollow space 18. Together with the through holes 15 and the acoustic resistors 16, the hollow space 18 forms a phase-shift circuit to obtain directivity. The frequency dependence of the unidirectional microphone unit controls the vibration of the diaphragm 13 by the acoustic resistors 16. If a resistance value of the acoustic resistors 16 is increased, the directivity is decreased to finally provide no directivity.

In a DC-bias capacitor microphone, a DC-bias voltage is applied through a high resistance between a vibrating membrane and a back plate. In the case shown in FIG. 8, a DC power source for biasing is connected between the diaphragm 13 and the outer casing 11 (not shown) so that the outer casing 11 and the case 12 function as the high resistance.

By a change in capacitance of the microphone unit shown in FIG. 8, a change in voltage occurred between both ends of the high resistance (that is, between the outer casing 11 and the terminal 14*aa*) is obtained as an electric signal.

Conventionally, as described in Japanese Patent Application Publication No. Sho 60-22897, a so-called MS microphone, which uses a unidirectional microphone unit and a bidirectional microphone unit to obtain a stereophonic sound, has been proposed.

SUMMARY OF THE INVENTION

If the diaphragm 13 of the unidirectional microphone unit shown in FIG. 8 is oriented toward a sound source situated on the front, sound on the rear side (behind the microphone unit) is cancelled by the offset between sound entering the microphone unit through the acoustic resistors 16 and the through holes 15 of the rear plate 12R and sound taking a detour from the back to the front to be introduced through the diaphragm 13.

However, the unidirectional microphone unit has a so-called proximity effect; when a sound source located behind is close to the microphone unit, a bass sound is enhanced in a sound coming from the sound source.

Since the MS microphone described in Japanese Patent Application Publication No. Sho 60-22897 includes the unidirectional microphone unit, the microphone unit is difficult to have a broad frequency characteristic to a bass sound range as in the case of a non-directional microphone unit, due to a structural characteristic of the unidirectional microphone unit. Furthermore, a directional characteristic in the bass sound range is inferior to that of a midrange.

The present invention is devised in view of the above circumstances and aims to provide a microphone capable of providing a two-channel stereo output and a four-channel stereo output with favorable directivity and frequency characteristic.

A microphone according to an embodiment of the present invention has:

(1) a first bidirectional microphone unit formed by connecting two unidirectional microphone units, each having a vibrating section on a front side, back to back; and a second bidirectional microphone unit formed by connecting two unidirectional microphone units, each having a vibrating section on a front side, back to back, the second bidirectional microphone unit being arranged so that its directional axis is shifted by 90 degrees with respect to that of the first bidirectional microphone unit.

In the unidirectional microphone, when a front side having a vibrating section (a diaphragm, a vibrating membrane or the like) is oriented toward a sound source, a rear sound is cancelled by the offset between a sound entering the microphone from the back and a sound taking a detour to enter from the front. As a result, the unidirectional microphone has unidirectionality to capture only a front sound.

The unidirectional microphone has a so-called proximity effect; when a sound source situated behind is close to the microphone unit, a bass sound is enhanced in a sound coming from the back. In the bidirectional microphone unit according to an embodiment of the present invention, however, among the unidirectional microphones connected to each other back to back, the vibrating section of one of the unidirectional microphones is situated on the rear face side of the other unidirectional microphone and the vibrating section of the other unidirectional microphone is situated on the rear face side of one unidirectional microphone. Therefore, each of the vibrating sections acts as a compliance for correcting the proximity effect (an acoustic compliance; $cm^3/\mu bar$) to keep the unidirectionality even in a relatively low frequency.

Since the compliance has an increasing reactance as a frequency becomes lower, an acoustic pressure of an acoustic wave introduced from the back of the microphone becomes gradually smaller. Specifically, the characteristic of the microphone becomes closer to that of a non-directional microphone whose back is closed. Therefore, a frequency characteristic on the front side becomes flat to a bass sound range. As a result, favorable directivity and a broad frequency characteristic to a bass sound range can be obtained, which are not affected by a difference in frequency.

(2) The first bidirectional microphone unit inputs an acoustic signal corresponding to a front and rear channel, the second bidirectional microphone unit inputs an acoustic signal corresponding to a left and right channel, and the microphone includes a two-channel signal circuit for generating and outputting a two-channel acoustic signal of front left and front right channel, formed from the acoustic signal corresponding to the front channel output from the first bidirectional microphone unit and from the acoustic signal corresponding to the left and right channel output from the second bidirectional microphone unit.

With the first and the second bidirectional microphone units and the two-channel signal circuit, a two-channel stereo microphone having favorable directivity that is not varied by a difference in frequency can be configured.

(3) The first-bidirectional microphone unit inputs an acoustic signal corresponding to a front and rear channel, the second bidirectional microphone unit inputs an acoustic signal corresponding to a left and right channel, and the microphone includes a four-channel signal circuit for generating and outputting four-channel acoustic signals of front left, front right, rear left and rear right channel, formed from the acoustic signal corresponding to the front and rear channel output from the first bidirectional microphone unit and from the acoustic signal corresponding to the left and right channel output from the second bidirectional microphone unit.

With the first and the second bidirectional microphone units and the four-channel signal circuit, a four-channel stereo microphone having favorable directivity that is not varied by a difference in frequency can be configured.

(1) According to the present invention, a characteristic expanding even in a bass sound range can be obtained in terms of frequency characteristic as compared with a stereo microphone configured by a general directional microphone.

(2) The microphone according to the present invention does not have the proximity effect, which is a characteristic of a directional microphone. Therefore, a phenomenon that an output in a bass sound range increases if a distance to a sound source is small does not occur.

(3) Furthermore, the directivity of the stereo microphone consisting of a general directional microphone varies depending on a frequency. In particular, in a bass sound range, a characteristic becomes closer not to a cardioid characteristic but to bidirectionality. According to the present invention, however, a cardioid characteristic can be realized even in a bass sound range.

(4) According to the invention recited in claim 3, by adding a circuit to the configuration of the two-channel stereo microphone, the four-channel stereo microphone can be realized.

DESCRIPTION OF THE PREFERRED EMBODIMENTS

Figure 1:
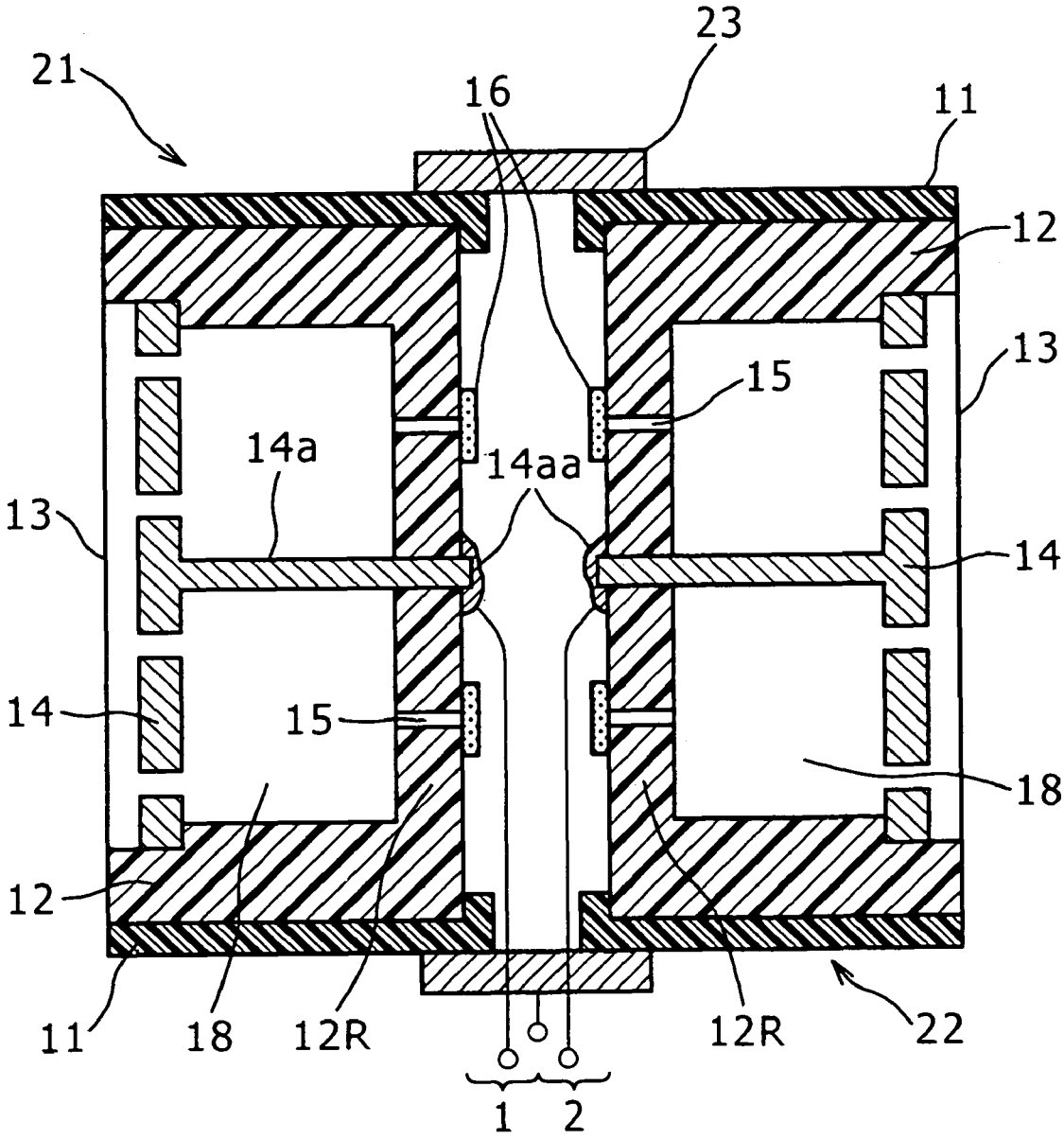
FIG. 1 is a simplified schematic internal configuration diagram showing an embodiment of a bidirectional microphone unit according to the present invention.

Hereinafter, an embodiment of the present invention will be described with reference to the accompanying drawings. However, the present invention is not limited to the following embodiment. FIG. 1 shows a bidirectional microphone unit obtained by connecting a pair of the unidirectional microphone units shown in FIG. 8 back to back so as to be opposed to each other. In FIG. 1, the same components are denoted by the same reference numerals as those in FIG. 8.

Figure 8:
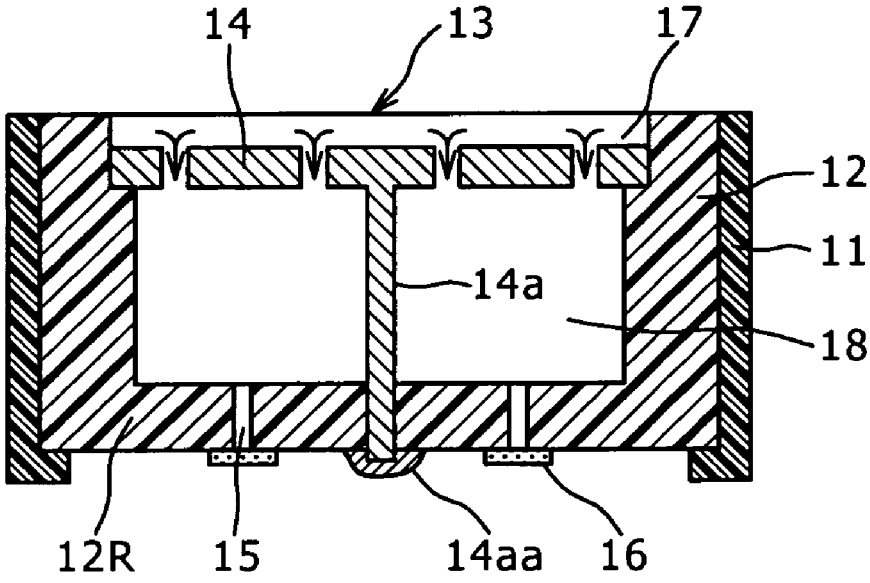
FIG. 8 PRIOR ART
FIG. 8 is a simplified schematic internal configuration diagram of a directional microphone unit.

Each of the reference numerals 21 and 22 denotes a unidirectional microphone unit configured in the same manner as the microphone unit shown in FIG. 8. The rear plates 12R of the unidirectional microphone units 21 and 22 are arranged to be opposed to each other with a predetermined gap there between. The outer casings 11 of the microphone units 21 and 22 are connected to each other with a metal connection ring 23 having an axial dimension which allows the connection of the two microphone units 21 and 22.

In the bidirectional microphone unit shown in FIG. 1, an output from the unidirectional microphone unit 21 is obtained as an output 1 which is output from between the terminal 14*aa* of the microphone unit 21 and the metal connection ring 23, whereas an output from the unidirectional microphone unit 22 is obtained as an output 2 which is output from between the terminal 14*aa* of the microphone unit 22 and the metal connection ring 23.

The structure of each of the components of the unidirectional microphone units 21 and 22 shown in FIG. 1 is the same as that of FIG. 8. A bias voltage is applied to the unidirectional microphone units 21 and 22 as in the case of FIG. 8. However, if bias voltages of the same polarity are applied to the diaphragms 13 of the microphone units 21 and 22, respectively, output voltages from the diaphragms 13 exhibit cardioid characteristics in the opposite directions. A non-directional microphone is realized by summing these outputs. If bias voltages of the opposite polarities are applied to the diaphragms 13 of the microphone units 21 and 22 to obtain the sum of the outputs, a bidirectional microphone is realized.

In the microphone shown in FIG. 1, on the back side of one of the microphone units, for example, the unidirectional microphone unit 21, the diaphragm 13 of the other unidirectional microphone unit 22 is present. On the back side of the other unidirectional microphone unit 22, the diaphragm 13 of the unidirectional microphone unit 21 is present. Therefore, the two diaphragms 13 function as a compliance for correction of the proximity effect and the unidirectionality is kept even in a relatively low frequency.

Since the connected compliance has an increasing reactance as a frequency becomes lower, an acoustic pressure of an acoustic wave introduced from the back of the microphone becomes gradually smaller. Specifically, the characteristic of the microphone becomes closer to that of a non-directional microphone having a closed back. For this reason, a frequency characteristic on the front side becomes flat to a bass sound range.

Figure 2:
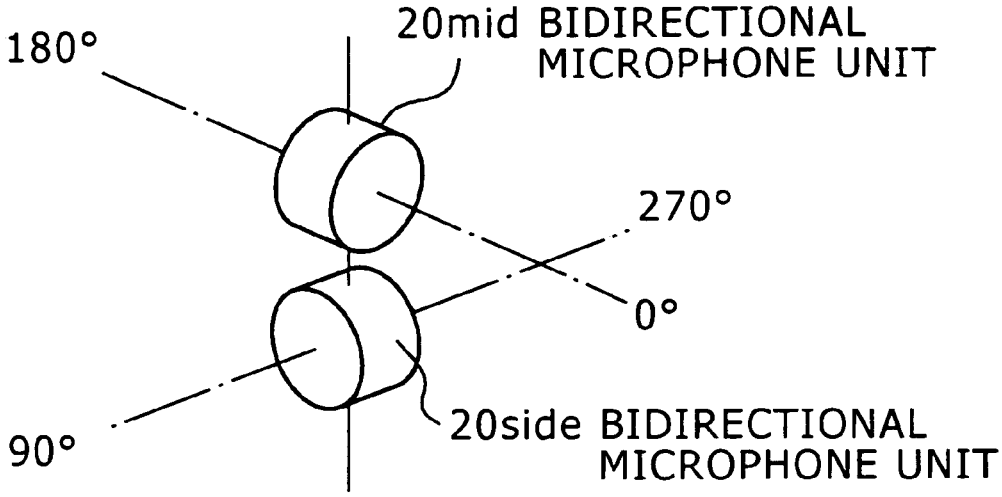
FIG. 2 is a perspective view of a main part, showing an embodiment in which a first bidirectional microphone unit and a second bidirectional microphone unit according to the present invention are vertically arranged.
Figure 3:
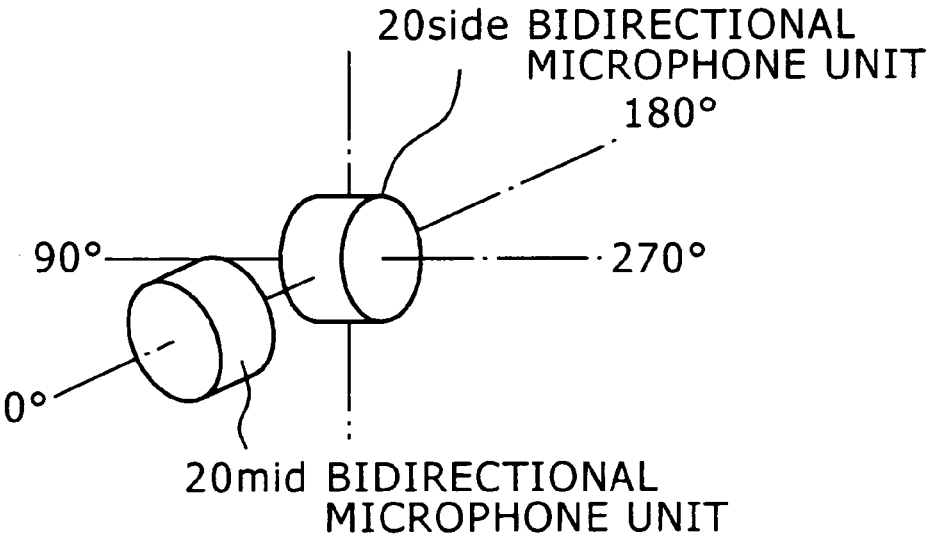
FIG. 3 is a perspective view of a main part, showing an embodiment in which the first and the second bidirectional microphone units according to the present invention are horizontally arranged.

Each of FIGS. 2 and 3 shows the arrangement of bidirectional microphone units forming the microphone according to the embodiment of the present invention. In FIG. 2, bidirectional microphone units 20*mid* and 20*side*, each being configured in the same manner as in FIG. 1, are arranged in a vertical direction with respect to a sound source with a predetermined gap therebetween. The microphone units 20*mid* and 20*side* are provided so that their directional axes are shifted by 90 degrees each other.

More specifically, a 0-degree direction is a recorded sound source direction. The bidirectional microphone unit 20*mid* is provided so as to be oriented in the 0-degree direction and a 180-degree direction at the upper position of a vertical axis, whereas the bidirectional microphone unit 20*side* is provided so as to be oriented in a 90-degree direction and a 270-degree direction at the lower position of the same vertical axis.

In FIG. 3, the bidirectional microphone units 20*mid* and 20*side*, each being configured in the same manner as in FIG. 1, are arranged in a horizontal direction with respect to a sound source with a predetermined gap therebetween. The directional axes of the microphone units 20*mid* and 20*side* are provided to form 90 degrees therebetween.

More specifically, a 0-degree direction is a recorded sound source direction. The bidirectional microphone unit 20*mid* is provided so as to be oriented in the 0-degree direction and a 180-degree direction at a predetermined position on a horizontal axis, whereas the bidirectional microphone unit 20*side* is provided so as to be oriented in a 90-degree direction and a 270-degree at a position which is a predetermined distance away from the microphone unit 20*mid* in the horizontal direction.

Figure 4:
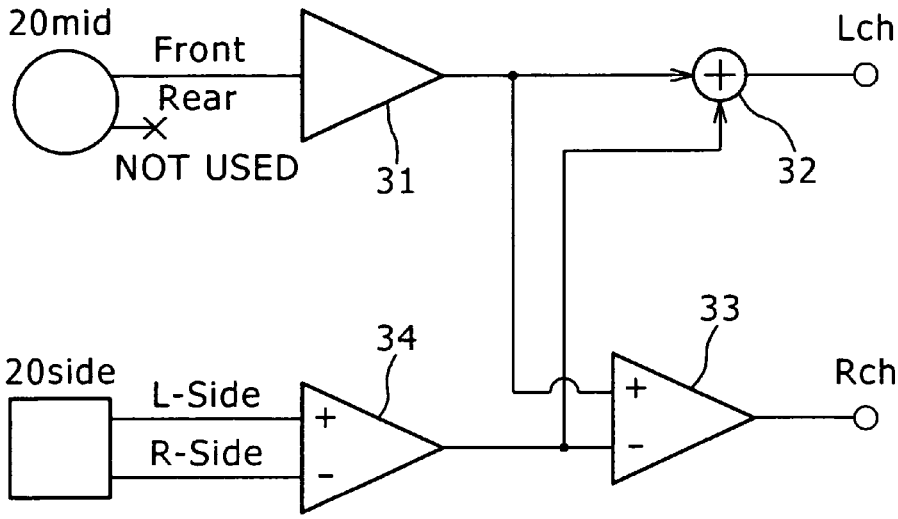
FIG. 4 is a circuit diagram of an embodiment in which a two-channel stereo microphone is realized by the present invention.
Figure 5:
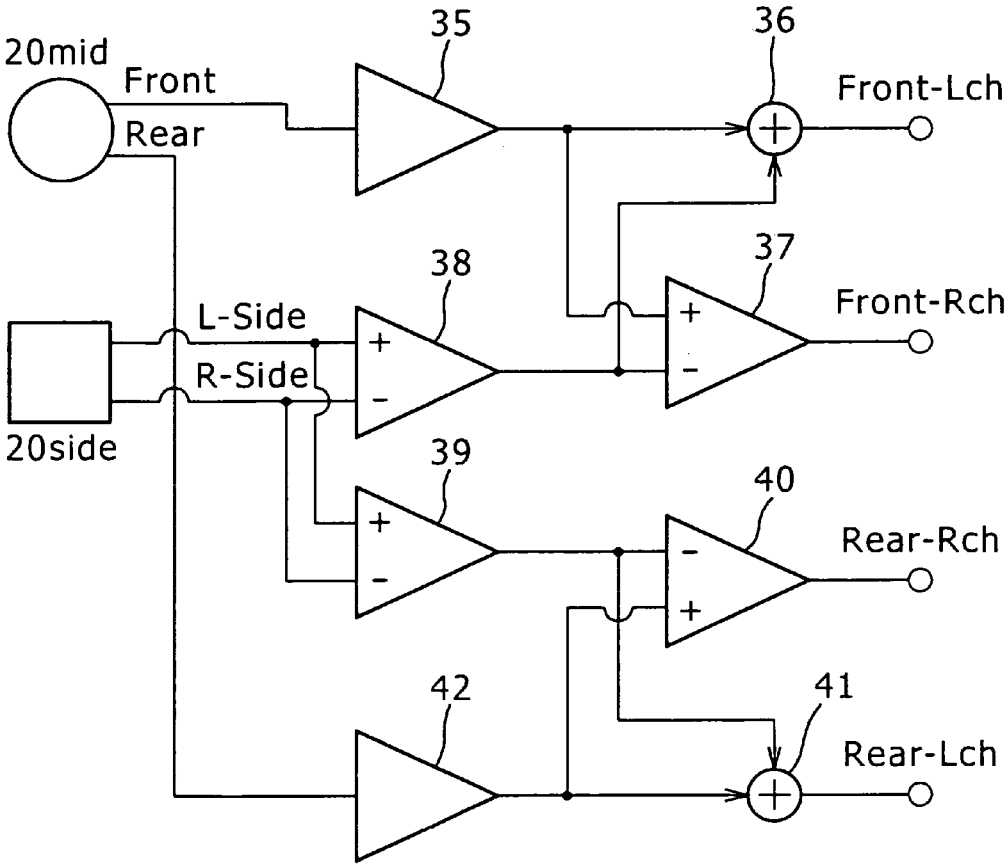
FIG. 5 is a circuit diagram of an embodiment in which a four-channel stereo microphone is realized by the present invention.

The microphone units are formed to have a circuit configuration as shown in FIG. 4 or FIG. 5 to constitute a two-channel stereo microphone or a four-channel stereo microphone.

Specifically, FIG. 4 shows an example of a two-channel signal circuit for obtaining two-channel acoustic signals, i.e., front right and front left (two-channel stereo outputs) from outputs of the microphone units arranged as shown in FIG. 2 or FIG. 3.

In FIG. 4, an output Front of the bidirectional microphone unit 20*mid* corresponds to an output of the directional microphone unit oriented in the 0-degree direction with respect to the sound source as described with reference to FIGS. 2 and 3, specifically, for example, the output 1 in FIG. 1. An output Rear corresponds to an output of the directional microphone unit oriented in the 180-degree direction with respect to the sound source described with reference to FIGS. 2 and 3, specifically, for example, the output 2 in FIG. 1.

An output L-side of the bidirectional microphone unit 20*side* corresponds to an output of the directional microphone unit oriented in the 270-degree direction with respect to the sound source as described with reference to FIGS. 2 and 3, specifically, for example, the output 1 in FIG. 1. An output R-side corresponds to an output of the directional microphone unit oriented in the 90-degree direction with respect to the sound source described with reference to FIGS. 2 and 3, specifically, for example, the output 2 in FIG. 1.

The output Front of the bidirectional microphone unit 20*mid* passes through an amplifier 31 to be input to one of input terminals of an adder 32 and a non-inverting input terminal of a differential amplifier 33. The output L-side of the bidirectional microphone unit 20*side* is input to a non-inverting input terminal of a differential amplifier 34, whereas the output R-side is input to an inverting input terminal of the differential amplifier 34.

An output of the differential amplifier 34 is input to the other input terminal of the adder 32 and an inverting input terminal of the differential amplifier 33. An output of the adder 32 is output as an L-channel, whereas an output of the differential amplifier 33 is output as an R-channel. In FIG. 4, the output Rear of the bidirectional microphone unit 20*mid* is not used.

FIG. 5 shows an example of a four-channel signal circuit for obtaining four-channel acoustic signals (four-channel stereo outputs), i.e., front left, right, rear left and right, from outputs of the microphone units arranged as shown in FIG. 2 or 3.

The output Front of the bidirectional microphone unit 20*mid* passes through an amplifier 35 to be input to one of input terminals of an adder 36 and a non-inverting input terminal of a differential amplifier 37. The output L-side of the bidirectional microphone unit 20*side* is input to a non-inverting input terminal of a differential amplifier 38 and a non-inverting input terminal of a differential amplifier 39, whereas the output R-side is input to an inverting input terminal of the differential amplifier 38 and an inverting input terminal of the differential amplifier 39.

An output of the differential amplifier 38 is input to an inverting input terminal of the differential amplifier 37 and the other input terminal of the adder 36. An output of the adder 36 is output as a Front-L-channel, whereas an output of the differential amplifier 37 is output as a Front-R-channel. An output of the differential amplifier 39 is input to an inverting input terminal of a differential amplifier 40 and one of input terminals of an adder 41.

The output Rear of the bidirectional microphone unit 20*mid* passes through an amplifier 42 to be input to a non-inverting input terminal of the differential amplifier 40 and the other input terminal of the adder 41. An output of the differential amplifier 40 is output as a Rear-R-channel, whereas an output of the adder 41 is output as a Rear-L-channel.

In any of the cases of the two-channel stereo microphone shown in FIG. 4 and the four-channel stereo microphone shown in FIG. 5 above, favorable directivity and frequency characteristic as described with reference to FIG. 1 are obtained.

Figure 6:
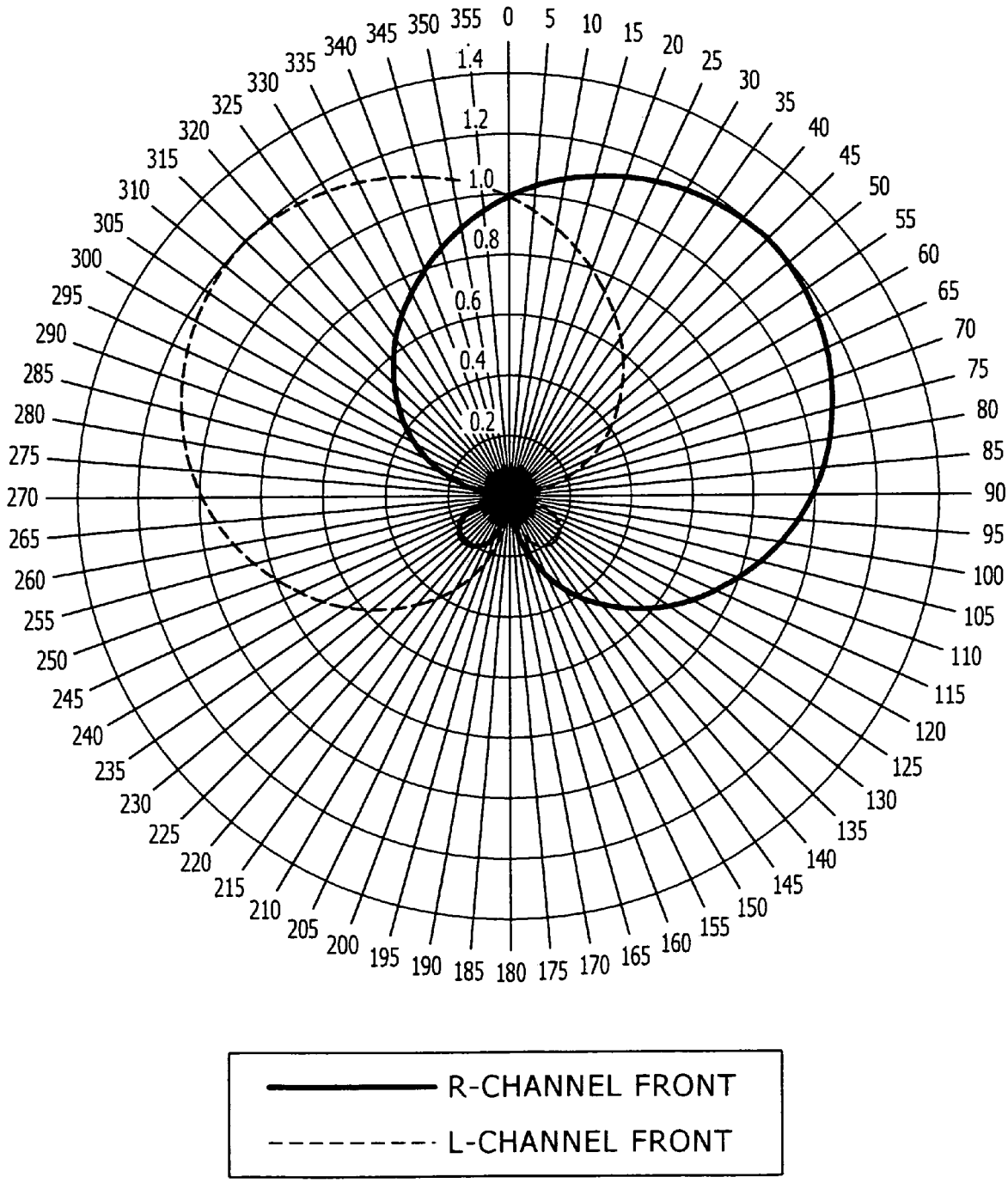
FIG. 6 is a characteristic view showing a polar pattern of the two-channel stereo microphone according to an embodiment of the present invention.

FIG. 6 shows an example of a directional angle pattern of the two-channel stereo microphone shown in FIG. 4. According to the embodiment of the present invention, even in a low-frequency band, the directional characteristic shown in FIG. 6 is obtained.

Figure 7:
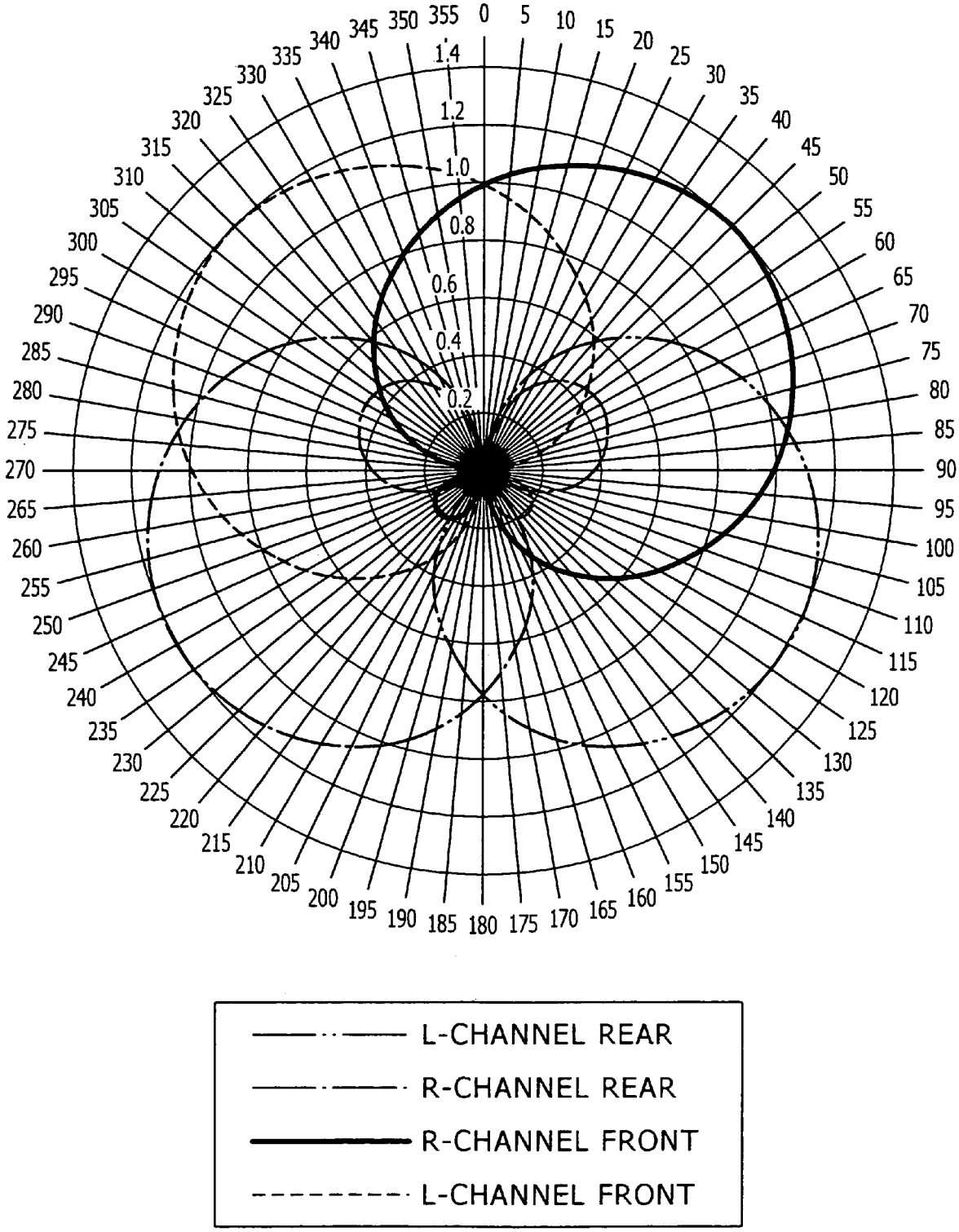
FIG. 7 is a characteristic view showing a polar pattern of the four-channel stereo microphone according to an embodiment of the present invention.

FIG. 7 shows an example of a directional angle pattern of the four-channel stereo microphone shown in FIG. 5. According to the embodiment of the present invention, even in a low-frequency band, the directional characteristic shown in FIG. 7 is obtained.

The arrangement of the first and the second bidirectional microphone units (20*mid* and 20*side*) according to the embodiment of the present invention is not limited to those shown in FIGS. 2 and 3. Any arrangement can be used as long as their directional axes are shifted by 90 degrees.

The two-channel signal circuit according to the embodiment of the present invention is not limited to that shown in FIG. 4, and the four-channel signal circuit according to the present invention is not limited to that shown in FIG. 5. Each of the two-channel signal circuit and the four-channel signal circuit may be configured with another circuit having a similar function.

It should be understood by those skilled in the art that various modifications, combinations, sub-combinations and alterations may occur depending on design requirements and other factors insofar as they are within the scope of the appended claims or the equivalents thereof.

The present invention contains subject matter related to Japanese Patent Application JP2005-124767, filed in the Japanese Patent Office on Apr. 22, 2005, the entire contents of which being incorporated herein by reference.

What is claimed is:

1. A microphone comprising:

a first bidirectional microphone unit formed by connecting a first set of two unidirectional microphone units, each of which has a cylindrical case assembly and a vibrating section, the cylindrical case assembly including a cylindrical inner case and a cylindrical outer case connected to and surrounding the cylindrical inner case, the cylindrical case assembly having a front side and a rear side, the cylindrical inner case including a rear plate having a plurality of through holes formed therethough and connected at the rear side thereof and the vibrating section connected to the front side thereof with bias voltages of opposite polarities being applied to the vibrating sections of the first set of two unidirectional microphone units;

a second bidirectional microphone unit formed by connecting a second set of two unidirectional microphone units, each of which has a cylindrical case assembly and a vibrating section, the cylindrical case assembly including a cylindrical inner case and a cylindrical outer case connected to and surrounding the cylindrical inner case, the cylindrical case assembly having a front side and a rear side, the cylindrical inner case including a rear plate having a plurality of through holes formed therethough and connected at the rear side thereof and the vibrating section connected to the front side thereof with bias voltages of opposite polarities being applied to the vibrating sections of the second set of two unidirectional microphone units; and a metal connection ring for each one of the first and second bidirectional microphone units, wherein respective ones of each of the two unidirectional microphone units are axially aligned relative to each other with the rear plates being spaced apart from and facially opposed to each other, wherein a respective one of the metal connection rings is connected to the respective cylindrical outer cases and surrounds a rear portion of the respective cylindrical inner cases and the cylindrical outer cases of each axially-aligned two unidirectional microphone units in a manner to form a gap between the respective ones of the facially-opposing rear plates, respective ones of the metal connection rings extending axially in contact with the respective rear portions of the cylindrical outer cases and surrounding only a rearward portion of the respective ones of the facially-opposing rear plates while enclosing the gap and wherein a directional axis of the second bidirectional microphone unit is arranged to be shifted by 90 degrees with respect to a directional axis of the first bidirectional microphone unit.

2. The microphone according to claim 1, wherein the first bidirectional microphone unit inputs an acoustic signal corresponding to a front and rear channel, the second bidirectional microphone unit inputs an acoustic signal corresponding to a left and right channel, and the microphone comprises a two-channel signal circuit for generating and outputting a two-channel acoustic signal of front left and front right channel, which is formed from the acoustic signal corresponding to the front channel output from the first bidirectional microphone unit and the acoustic signal corresponding to the left and right channel output from the second bidirectional microphone unit.

3. The microphone according to claim 1, wherein the first bidirectional microphone unit inputs an acoustic signal corresponding to a front and rear channel, the second bidirectional microphone unit inputs an acoustic signal corresponding to a left and right channel, and the microphone comprises a four-channel signal circuit for generating and outputting a four-channel acoustic signal of front left, front right, rear left and rear right channel, which is formed from the acoustic signal corresponding to the front and rear channel output from the first bidirectional microphone unit and the acoustic signal corresponding to the left and right channel output from the second bidirectional microphone unit.

4. The microphone according to claim 1, wherein each one of the cylindrical inner cases has an electrically-conductive electrode bar, a diaphragm and a back plate disposed between and spaced apart from the diaphragm and the rear plate with the cylindrical inner case connected to and surrounding at least the back plate and with the electrode bar connected to and extending from the back plate and through the rear plate to terminate in an electrically conductive terminal.

5. The microphone according to claim 4, wherein respective ones of each of the first and second bidirectional microphone units includes a pair of output terminal leads, a respective output terminal lead is electrically connected to a respective one of the electrically-conductive electrode bars and extends from the electrically-conductive electrode bar and through the gap and the metal connection ring to terminate exteriorly of the metal connection ring.

* * * * *